US011035213B2

(12) United States Patent
Dusterhoft et al.

(10) Patent No.: US 11,035,213 B2
(45) Date of Patent: Jun. 15, 2021

(54) PRESSURE CONTROLLED WELLBORE TREATMENT

(71) Applicant: Halliburton Energy Services, Inc., Houston, TX (US)

(72) Inventors: Ronald Glen Dusterhoft, Katy, TX (US); Stanley Vernon Stephenson, Duncan, OK (US); Timothy Holiman Hunter, Duncan, OK (US); Mehdi Mazrooee, Double Oak, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 94 days.

(21) Appl. No.: 16/405,595

(22) Filed: May 7, 2019

(65) Prior Publication Data

US 2020/0355055 A1 Nov. 12, 2020

(51) Int. Cl.
*E21B 43/114* (2006.01)
*E21B 43/25* (2006.01)
*E21B 43/26* (2006.01)

(52) U.S. Cl.
CPC ..... *E21B 43/26* (2013.01); *E21B 43/114* (2013.01); *E21B 43/255* (2013.01)

(58) Field of Classification Search
CPC ..... E21B 43/114; E21B 43/255; E21B 43/26
See application file for complete search history.

(56) References Cited

U.S. PATENT DOCUMENTS 4,047,569 A 9/1977 Tagirov et al.
5,275,041 A 1/1994 Poulsen
5,482,116 A 1/1996 El-Rabaa et al.
6,367,548 B1 4/2002 Purvis et al.
9,217,318 B2 * 12/2015 Dusterhoft ..... E21B 43/25
9,297,250 B2 * 3/2016 Dusterhoft ..... E21B 47/06
9,410,406 B2 8/2016 Yuan
10,422,207 B2 * 9/2019 Aidagulov ..... E21B 43/305
(Continued)

OTHER PUBLICATIONS

International Search Report and Written Opinion issued in related PCT Application No. PCT/US2020/017885 dated Jun. 19, 2020, 10 pages.

*Primary Examiner* — Matthew R Buck
(74) *Attorney, Agent, or Firm* — John W. Wustenberg; Baker Botts L.L.P.

(57) ABSTRACT

To improve or optimize a wellbore treatment operation, a target net treating pressure may be determined and the constant net treating pressure maintained to effectively enhance formation breakdown and fracture complexity as well as provide a reduction in wear and tear of equipment and completion time. The target net treating pressure may be based on one or more treatment parameters and these parameters may be adjusted during the wellbore treatment operation to maintain a constant net treating pressure at or about the target net treating pressure. The injection rate or pressure of a treatment fluid may be adjusted to maintain the constant net treating pressure. Measurements associated with the wellbore treatment operation may be compared to an operational constraint and adjustments to the wellbore treatment operation may be made based on the comparison. The wellbore treatment operation may be terminated based on a parameter falling below or exceeding a threshold.

20 Claims, 4 Drawing Sheets

(56) References Cited

U.S. PATENT DOCUMENTS

| | | | | |
|---|---|---|---|---|
| 2006/0155473 | A1* | 7/2006 | Soliman | E21B 49/00 702/12 |
| 2007/0272407 | A1* | 11/2007 | Lehman | E21B 43/26 166/250.1 |
| 2008/0041594 | A1* | 2/2008 | Boles | E21B 43/26 166/305.1 |
| 2011/0067857 | A1* | 3/2011 | Underhill | E21B 47/06 166/250.01 |
| 2011/0120702 | A1* | 5/2011 | Craig | E21B 43/26 166/250.1 |
| 2011/0120705 | A1* | 5/2011 | Walters | E21B 43/16 166/270 |
| 2011/0120706 | A1* | 5/2011 | Craig | E21B 43/26 166/270 |
| 2011/0120718 | A1* | 5/2011 | Craig | E21B 43/16 166/308.1 |
| 2011/0125471 | A1* | 5/2011 | Craig | G01V 1/42 703/6 |
| 2011/0125476 | A1* | 5/2011 | Craig | G01V 1/288 703/10 |
| 2013/0140031 | A1* | 6/2013 | Cohen | E21B 43/26 166/308.1 |
| 2014/0262232 | A1 | 9/2014 | Dusterhoft et al. | |
| 2017/0254186 | A1* | 9/2017 | Aidagulov | E21B 43/00 |

* cited by examiner

PRESSURE CONTROLLED WELLBORE TREATMENT

TECHNICAL FIELD OF THE INVENTION

The present disclosure relates generally to wellbore treatment operations and more particularly to a constant pressure controlled treatment of a wellbore.

BACKGROUND

Hydrocarbons, such as oil and gas, are produced from subterranean reservoir formations that may be located onshore or offshore. The effective permeability of a subterranean formation may be increased by using a wellbore treatment operation, such as, a stimulation operation. For example, a stimulation treatment may initiate a perforation in wellbore casing through fluid jetting or shape charges and form a fracture in the subterranean formation to increase production of a hydrocarbon from the subterranean formation. During such a stimulation treatment, a fluid may be pumped or injected into the subterranean formation at a high pressure, for example, through a wellbore. The pressure of this fluid passes through the wellbore casing perforations and forms fractures in the subterranean formation.

During the early stages of a wellbore treatment operation, fracture tortuosity or complexity may result in excessively high treating pressures due to high leak off into near wellbore fractures. In traditional wellbore treatment operations, a constant injection rate of fluids is maintained as the downhole wellbore pressure is not known. Such constant rate of injection at high pressures increases wear and tear to the wellbore treatment operation equipment which increases overall operation costs. An improved and more accurate downhole wellbore pressure estimate is needed such that treating pressures can be continuously varied to achieve a desired pressure profile that efficiently and effectively enhances formation breakdown and fracture complexity.

Figure 1:
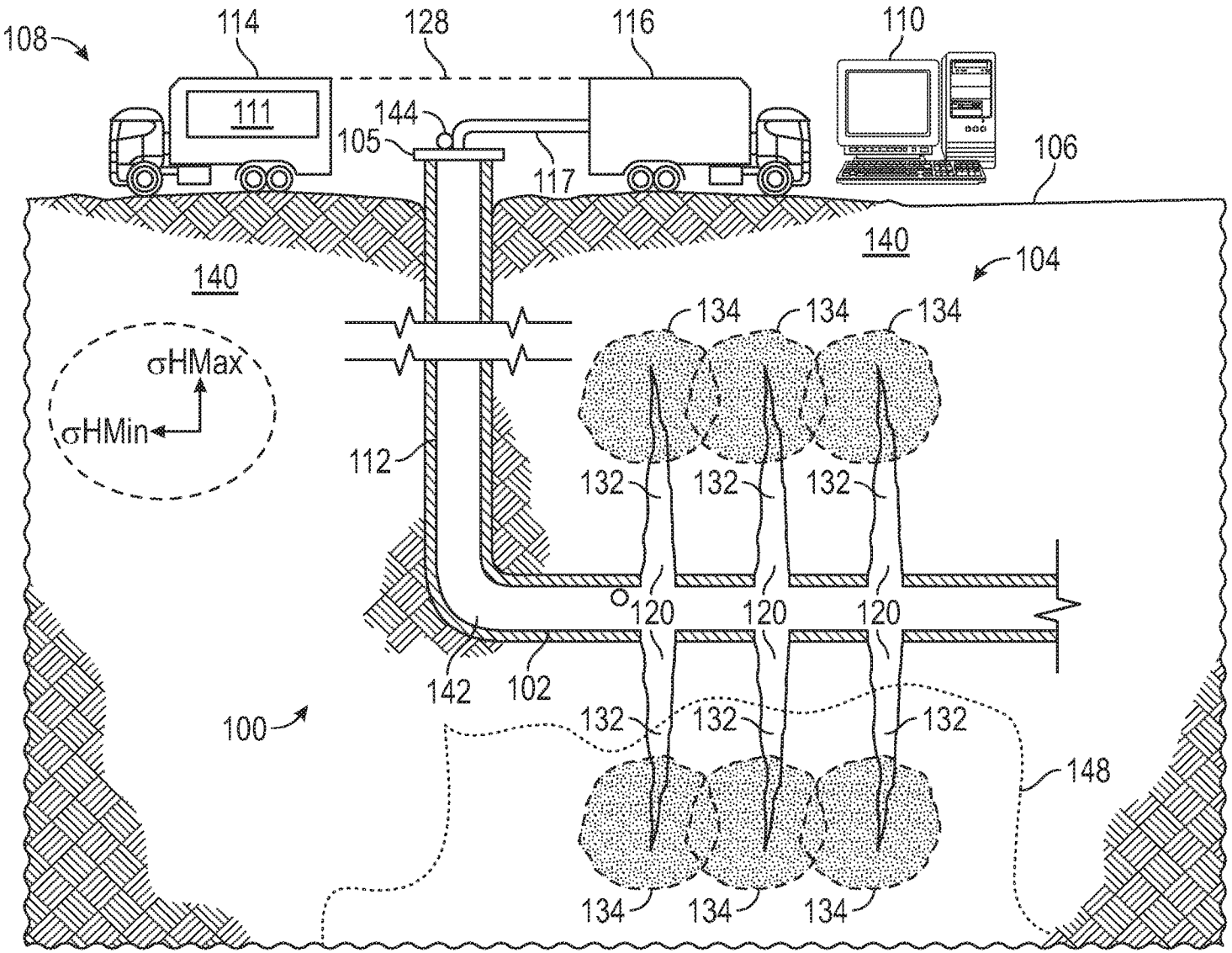
FIG. 1 is a schematic diagram of a well system, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure. Like reference symbols in the various drawings indicate like elements.

DETAILED DESCRIPTION

One or more aspects of the present invention improve or optimize wellbore treatment operations, such as a stimulation or fracturing operation or a cementing operation. For example, a hydraulic stimulation or fracture treatment may be designed for multi-stage horizontal well completions or other types of completions in unconventional reservoirs or other types of subterranean formations. One or more aspects of the present invention provides validation (for example, in real time during stimulation treatment, an injection treatment or post-treatment) that the desired treatment properties (for example, pressure profile) are achieved and provides accurate and efficient control of net treating pressure (or treating pressure), improved discrimination of leak-off, earlier detection of extensive fracture growth in height, length or both, reduction in well bashing through earlier far field diversion, control of the degree of fracture complexity by managing the pressure set points at selected times during the wellbore operation treatment, improved distribution of fluid in different cluster due to erosion and optimization of surface wellbore treatment operation equipment including, but not limited to, reduction in wear and tear and completion time.

For one or more wellbore treatment operations, a target net treating pressure (or treating pressure) is determined or estimated to improve or optimize the wellbore treatment operation. The target net treating pressure can refer to an optimal, favorable, or otherwise designated value or range of values of net treating pressure. In the context of a stimulation or an injection treatment, the net treating pressure indicates the extent to which the fluid pressure applied to the subterranean rock (for example, the bottom hole treating pressure) exceeds the rock closure stress (for example, the minimum horizontal rock stress). As such, a target net treating pressure may indicate a desired net treating pressure to be applied to the rock formation by an injection treatment. The actual net treating pressure can be observed during the stimulation or injection treatment, and the fluid injection can be modified (for example, by increasing or decreasing fluid pressure) when the actual net treating pressure falls outside (for example, above or below) the target range.

Generally, the pressure of injected fluids acting on the rock formation during a stimulation, perforation or fracture treatment can initiate, dilate, or propagate hydraulic fissures or fractures. For example, hydraulically induced or created fractures can be initiated at or near the perforations in the wellbore casing, and the fractures can grow from the wellbore in the direction of maximum horizontal stress. As another example, the stimulation or injection treatment can induce leak-off and dilate natural fissures or fractures in the rock formation. Dilating natural fissures or natural fractures can increase the stimulated reservoir volume and the connected fracture surface area. But excessively high net treating pressure can lead to fracture reorientations and interconnections of dominant fractures, which hinder the increase of the stimulated reservoir volume and the connected peroration or fracture surface area.

According to one or more aspects of the present disclosure, one or more systems and methods may be used to determine a target net treating pressure that maximizes or otherwise improves the stimulated reservoir volume and the number of perforations connected to created fractures and fracture surface area by maintaining the wellbore treatment operation at a constant net treating pressure. In one or more embodiments, the target net treating pressure may be determined based on modeling perforation breakdown or fracture growth orientation in the subterranean region. For example in some cases, the target net treating pressure is the maximum net treating pressure that can be achieved without causing undesired fracture reorientation. In one or more embodiments, the target maximum net treating pressure may be determined in relation to a difference between minimum and maximum horizontal stresses in the subterranean region. In some instances, the target net treating pressure optimizes or otherwise improves the injection treatment design toward maximizing resource production from the subterranean region.

A wellbore treatment operation, for example, a cementing operation or a stimulation or an injection treatment, may be controlled or otherwise altered by monitoring the flow or injection rate of a fluid and comparison of the injection rate to a threshold or target injection rate. Based on the comparison, the flow rate of the fluid may be adjusted to maintain the wellbore treatment operation at a constant net treating pressure.

In one or more embodiments of the present disclosure, an environment may utilize an information handling system to control, manage or otherwise operate one or more operations, devices, components, networks, any other type of system or any combination thereof. For purposes of this disclosure, an information handling system may include any instrumentality or aggregate of instrumentalities that are configured to or are operable to compute, classify, process, transmit, receive, retrieve, originate, switch, store, display, manifest, detect, record, reproduce, handle, or utilize any form of information, intelligence, or data for any purpose, for example, for a maritime vessel or operation. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data, instructions or both for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming, but would nevertheless be a routine undertaking for those of ordinary skill in the art having the benefit of the present disclosure.

The terms "couple" or "couples," as used herein are intended to mean either an indirect or direct connection. Thus, if a first device couples to a second device, that connection may be through a direct connection, or through an indirect electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

FIG. 1 illustrates a well system 100 for performing a wellbore treatment operation, according to one or more aspects of the present invention. Well system or well treatment system 100 comprises a computing subsystem 110. In one or more embodiments, computing subsystem 110 may comprise one or more information handling systems, for example, information handling system 400 of FIG. 4. Computing subsystem 110 may be located at, near or remote from the well system 100. For example, computing subsystem 110 may be located at a data processing center, a computing facility or another suitable location.

Well system 100 comprises a wellbore 102 in a subterranean formation 140 beneath the ground surface 106. Subterranean formation 140 may comprise a subterranean region 104. While wellbore 102 is a substantially horizontal wellbore, the present disclosure contemplates any combination of horizontal, vertical, slant, cured, or other wellbore orientations. Additionally, wellbore 102 may be disposed or positioned in a subsea environment. In one or more embodiments, the well system 100 may comprise one or more additional treatment wells, observation wells, or other types of wells. Subterranean formation 140 or subterranean region 104 may comprise a reservoir 148 that contains hydrocarbon resources, such as oil, natural gas, any other resource and any combination thereof. For example, the subterranean formation 140 or subterranean region 104 may include all or part of a rock formation (for example, shale, coal, sandstone, granite, or others) that contain natural gas. The subterranean formation 140 or subterranean region 104 may include naturally perforated fractured rock or natural rock formations that are not perforated or fractured to any significant degree. The subterranean formation 140 or subterranean region 104 may include tight gas formations that include low permeability rock (for example, shale, coal, or others).

Well system 100 comprises an injection system 108. Injection system 108 may be used to perform an injection treatment, whereby fluid is injected into the subterranean region 104 through the wellbore 102. In one or more embodiments, the injection treatment perforates or fractures part of a rock formation or other materials in the subterranean region 104. Creating one or more perforations or fractures, for example, one or more perforations or fractures 120, in subterranean region 104 may increase the surface area of the subterranean formation 140, which may increase the rate at which the subterranean formation 140 conducts fluid resources to the wellbore 102. For example, a stimulation or fracture treatment may augment the effective permeability of the rock by creating high permeability flow paths that permit native fluids (for example, hydrocarbons) to weep out of the reservoir rock into the perforation or fracture and flow through the reservoir 148 to the wellbore 102. The injection system 108 may utilize selective fracture valve control, information on stress fields around hydraulic perforations or fractures, real time fracture mapping, real time fracturing pressure interpretation, or other techniques to achieve desirable complex fracture geometries in the subterranean region 104.

One or more of a cementing, stimulation, injection or fracture treatment may be applied at a single fluid injection location or at multiple fluid injection locations in a subterranean region, such as subterranean region 104, where the fluid may be injected over a single time period or over multiple different time periods. In some instances, a stimulation or fracture treatment can use multiple different fluid injection locations in a single wellbore, multiple fluid injection locations in multiple different wellbores, or any suitable combination. Moreover, any one or more of the cementing, stimulation, injection or fracture treatment may inject fluid through any suitable type of wellbore, such as, for example, vertical wellbores, slant wellbores, horizontal wellbores, curved wellbores, or any suitable combination of these and others.

The injection system 108 may inject treatment fluid 142 into the subterranean region 104 from the wellbore 102. In one or more embodiments, treatment fluid 142 may comprise an acid, a cement, a proppant, a diverter, sand, mud, water, any other stimulation fluid and any combination thereof. The injection system 108 comprises instrument trucks 114, pump trucks 116, and an injection treatment control subsystem 111. The injection system 108 may comprise other features not shown in the figures. The injection system 108 may apply the injection treatments discussed with respect to FIG. 2 as well as other types of injection treatments. The injection system 108 may apply injection treatments that include, for example, a multi-stage stimulation or fracturing treatment, a cementing treatment, a single-stage stimulation or fracture treatment, a mini-stimulation or mini-fracture test treatment, a follow-on stimulation or fracture treatment, a re-stimulation or re-fracture treatment, a final stimulation or fracture treatment, other types of stimulation or fracture treatments, and any combination thereof.

The one or more pump trucks 116 may comprise mobile vehicles, immobile installations, skids, hoses, tubes, fluid tanks, fluid reservoirs, pumps, valves, mixers, or other types of structures and equipment. The one or more pump trucks 116 shown in FIG. 1 may supply treatment fluid 142 or other materials for the injection treatment. The one or more pump trucks 116 may contain multiple different treatment fluids, proppant materials, or other materials for different stages of a stimulation treatment. In one or more embodiments, the one or more pump trucks 116 may comprise electrically driven pumps that allow for maintenance of a constant net treating pressure as no momentary increases or decreases will occur during a gear shift which occurs with pumps driven through transmissions.

The one or more pump trucks 116 may communicate one or more treatment fluids 142 into the wellbore 102 at or near the level of the ground surface 106. The one or more treatment fluids 142 are communicated through the wellbore 102 from the ground surface 106 level by a conduit 112 installed, disposed or positioned in the wellbore 102. The conduit 112 may comprise casing cemented to the wall of the wellbore 102. In one or more embodiments, all or a portion of the wellbore 102 may be left open, without casing. The conduit 112 may comprise a working string, coiled tubing, sectioned pipe, or other types of conduit.

The one or more instrument trucks 114 may comprise mobile vehicles, immobile installations, or other suitable structures. The one or more instrument trucks 114 shown in FIG. 1 comprise an injection treatment control subsystem 111 that controls or monitors the injection treatment applied by the injection system 108. The communication links 128 may allow the one or more instrument trucks 114 to communicate with the one or more pump trucks 116, or other equipment at the ground surface 106. Additional communication links may allow the one or more instrument trucks 114 to communicate with sensors or data collection apparatus in the well system 100, remote systems, other well systems, equipment installed in the wellbore 102 or other devices and equipment. In some implementations, communication links allow the instrument trucks 114 to communicate with the computing subsystem 110 that may run injection simulations and provide one or more treatment parameters, for example, one or more injection treatment parameters. The well system 100 may comprise multiple uncoupled communication links or a network of coupled communication links. The communication links may comprise direct or indirect, wired or wireless communications systems, or a combination thereof.

The injection system 108 may also comprise one or more sensors 144 disposed at or about a surface or downhole to measure any one or more of pressure, rate, temperature, fluid density or any combination thereof of treatment fluid 142, downhole temperature at any one or more locations, and any one or more other parameters of treatment or production. For example, the one or more sensors 144 may comprise one or more pressure meters or other equipment that measure the pressure of fluids in the wellbore 102, including, but not limited to, treatment fluid 142, at or near the ground surface 106 level or at other locations. The injection system 108 may include pump controls or other types of controls for starting, stopping, increasing, decreasing or otherwise controlling pumping as well as controls for selecting or otherwise controlling fluids pumped during the injection treatment. The injection treatment control subsystem 111 may communicate with such equipment to monitor and control the injection treatment. In one or more embodiments, the injection treatment control subsystem 111 comprises one or more pump controls.

The injection system 108 may inject treatment fluid 142 into the subterranean formation 140 above, at or below a fracture initiation pressure for the subterranean formation 140, above, at or below a fracture closure pressure for the subterranean formation 140, or at another fluid pressure. Fracture initiation pressure may refer to a minimum fluid injection pressure that can initiate or propagate one or more fractures in the subterranean formation 140. Fracture closure pressure may refer to a minimum fluid injection pressure that can dilate existing fractures in the subterranean formation. In some instances, the fracture closure pressure is related to the minimum principal stress acting on the formation. The net treating pressure may, in some instances, refer to a bottom hole treating pressure (for example, at perforations or fractures 120) minus a fracture closure pressure or a rock closure stress. The rock closure stress may refer to the native stress in the formation that counters the fracturing of the rock.

The example injection treatment control subsystem 111 shown in FIG. 1 controls operation of the injection system 108. The injection treatment control subsystem 111 may include data processing equipment, communication equipment, or other systems that control injection treatments applied to the subterranean region 104 through the wellbore 102. The injection treatment control subsystem 111 may be communicably linked to the computing subsystem 110 that may calculate, select, or optimize one or more treatment parameters for initialization, propagation, or opening fractures in the subterranean region 104. The injection treatment control subsystem 111 may receive, generate or modify an injection treatment plan (for example, a pumping schedule) that specifies properties of an injection treatment to be applied to the subterranean region 104.

In some instances, the injection treatment control subsystem 111 may interface with controls of the injection system 108. For example, the injection treatment control subsystem 111 may initiate control signals that configure the injection system 108 or other equipment (for example, one or more pump trucks 116) to execute aspects of the injection treatment plan. The injection treatment control subsystem 111 may receive data collected from the subterranean region 104 or another subterranean region by sensing equipment, and the injection treatment control subsystem 111 may process the data or otherwise use the data to select or modify properties of an injection treatment to be applied to the subterranean region 104. The injection treatment control subsystem 111 may initiate control signals that configure or reconfigure the injection system 108 or other equipment based on selected or modified properties.

In one or more embodiments, the injection treatment control subsystem 111 controls the injection treatment in real time based on one or more measurements obtained during the injection treatment from one or more sensors 144. For example, in one or more embodiments, any one or more sensors 144 may comprise a pressure meter, a flow monitor, microseismic equipment, one or more fiber optic cables, a temperature sensor, an acoustic sensor, a tiltmeters, or other equipment that monitors the injection treatment. In one or more embodiments, observed pressures of the treatment fluid 142 may be used to determine when and in what manner to change any one or more of the one or more treatment parameters to achieve one or more desired perforation or fracture properties. For example, the injection treatment control subsystem 111 may control and change the target net treating pressure of an injection treatment to improve or maximize one or more active perforations that have been broken down and are connected to a fracture volume or a fracture surface area. Controlling or maintaining as a constant the net treating pressure may comprise modifying pumping pressure of one or more pumps, modifying pumping rates of one or more pumps, modifying pumping volumes of one or more pumps, modifying proppant concentrations, modifying fluid properties (for example, by adding or removing gelling agents to adjust viscosity), using diversion techniques, using stress interference techniques, optimizing or otherwise adjusting spacing between perforations, fracturing stages, or hydraulically induced fractures to control the degree of stress interference between fracturing stages, or any other appropriate methods to maintain the net treating pressure to within a desirable value or range.

In one or more embodiments, the one or more fractures 132 of subterranean region 104 may be created by injection system 108. The one or more fractures 132 may include fractures of any length, shape, geometry or aperture, that extend from perforations or existing fractures 120 along the wellbore 102 in any direction or orientation. The one or more fractures 132 may be formed by hydraulic injections at multiple stages or intervals, at different times or simultaneously. Fractures formed by a hydraulic injection tend to form along or approximately along a preferred fracture direction, which is typically related to the stress in the formation. FIG. 1 illustrates a preferred fracture direction that is perpendicular to the wellbore 102.

The one or more fractures 132 shown in FIG. 1, which are initiated by an injection treatment, extend from the wellbore 102 and terminate in the subterranean region 104. The one or more fractures 132 initiated by the injection treatment may be the dominant or main fractures in the region near the wellbore 102. The one or more fractures 132 may extend through one or more regions that include natural fracture networks 134, regions of un-fractured rock, or both. The natural fracture networks 134 can be described in terms of their fracture density, fracture length, fracture conductivity, any other property and any combination thereof. FIG. 1 illustrates the one or more dominant fractures 132 intersecting the one or more natural fracture networks 134. Through the one or more dominant fractures 132, high pressure hydraulic fracturing fluid, such as treatment fluid 142, may flow in the one or more natural fracture networks 134 and induce dilation of natural fractures and leak off of the treatment fluid 142 into the one or more natural fractures.

In one or more embodiments, by dilation of natural fractures, use of reactive fluids, use of very small, micron sized proppant materials, or other appropriate treatments, the conductivity or effective permeability of the dilated natural fractures can remain at least an order of magnitude higher than the matrix permeability of the rock itself. In one or more embodiments, if the matrix permeability of the reservoir rock is 100 nano Darcys, then the effective permeability of the dilated fracture would be at least 1000 nano Darcys or 1 micro Darcy. These dilated, leak off induced fractures then provide a path to the dominant hydraulic fracture to increase the exposed surface area and enhance the ability of hydrocarbon to flow through the created fracture system and into the wellbore.

Stresses of varying magnitudes and orientations may be present within a subterranean formation 140. In some cases, stresses in a subterranean formation 140 may be effectively simplified to three principal stresses. For example, stresses may be represented by three orthogonal stress components, which include a horizontal "x" component along an x-axis, a horizontal "y" component along a y-axis, and a vertical "z" component along a z-axis. Other coordinate systems may be used. The three principal stresses may have different or equal magnitudes. Stress contrast or stress anisotropy refers to a difference in magnitude between stress in a direction of maximum horizontal stress and stress in a direction of minimum horizontal stress in the formation.

In some instances, it may be assumed that the stress acting in the vertical direction is approximately equal to the weight of formation above a given location in the subterranean region 104. With respect to the stresses acting in the horizontal directions, one of the principal stresses may be of a greater magnitude than the other. In FIG. 1, the vector labeled σHMax indicates the magnitude of the stress in the direction of maximum horizontal stress in the indicated locations, and the vector labeled σHMin indicates the magnitude of the stress in the direction of minimum horizontal stress in the indicated locations. As shown in FIG. 1, the directions of minimum and maximum horizontal stress may be orthogonal. In one or more embodiments, the directions of minimum and maximum stress may be non-orthogonal. In FIG. 1, the stress anisotropy in the indicated locations is the difference in magnitude between σHMax and σHMin. In some implementations, σHMax, σHMin, or both may be determined by any suitable method, system, or apparatus.

For example, one or more stresses may be determined by a logging run with a dipole sonic wellbore logging instrument, a wellbore breakout analysis, a fracturing analysis, a fracture pressure test, or combinations thereof.

In one or more embodiments, the presence of horizontal stress anisotropy within a subterranean region or within a fracturing interval may affect the manner in which one or more fractures form in the region or interval. In a very brittle rock with ideal stress conditions of low stress anisotropy, hydraulic fracturing can create (or reopen) large, complex natural fracture networks. Under these conditions, fracture jobs can create a lattice pattern with increased reservoir contact. On the other hand, highly anisotropic stresses may impede the formation of, modification of, or hydraulic connectivity to complex fracture networks. For example, the presence of significant horizontal stress anisotropy in a formation may cause fractures to open along substantially a single orientation. Because the stress in the subterranean formation is greater in an orientation parallel to $\sigma HMax$ than in an orientation parallel to $\sigma HMin$, a fracture in the subterranean formation may resist opening at an orientation perpendicular to $\sigma HMax$. The created fracture may tend to be more planar in nature with natural fractures creating a source for fluid loss or leak off during fracturing. Some formations tend to develop less complex fracture systems generating less reservoir contact, but can still potentially activate any natural fractures that may exist through fluid leak off. Maximizing reservoir contact in this environment may require closer fracture spacing or diversion type solutions to increase the target net treating pressure to overcome the stress anisotropy, activate one or more natural fractures that may be present and promote more fracture complexity.

The one or more fractures 132 may be initiated at the perforations or fractures 120 by a stimulation or fracture treatment, and the one or more fractures 132 may grow from the wellbore 102 into the subterranean region 104. The one or more fractures 132 may grow in the direction of the maximum horizontal stress, and the fracture growth orientation is perpendicular to the direction of minimum horizontal stress. In one or more embodiments, increasing the net treating pressure (for example, above a critical or threshold pressure) may cause the fracture growth to reorient. For example, the one or more dominant fractures may begin to grow along the one or more natural fractures, in directions that are not perpendicular to the minimum horizontal stress. Consequently, in a multi-stage stimulation or fracturing treatment, reorientation of dominant fracture growth at different stages of the treatment may cause the one or more dominant fractures to intersect each other. As such, the pressure signature associated with one or more intersecting dominant fractures may be used to optimize or otherwise modify fracture spacing, perforation spacing, or other factors to minimize or otherwise reduce the likelihood of fracture reorientation.

In one or more embodiments, the injection treatment may be designed to produce one or more generally parallel, non-intersecting dominant fractures 132, as shown in FIG. 1, or another desired fracture orientation. For example, computer modeling and numerical simulations may be used to determine the maximum net treating pressure that produces a desired fracture growth orientation. In one or more embodiments, maintaining the net treating pressure below the stress anisotropy (for example, the difference between the maximum and minimum horizontal stresses) produces fracture growth in the maximum horizontal stress direction, while increasing the net treating pressure above the stress anisotropy can cause the fractures to grow at other orientations. As such, the target range of net treating pressure may have an upper limit that is designed to prevent fracture reorientation and in some instances, the upper limit may be determined based at least in part on the stress anisotropy in the formation. Other factors, such as connected fracture surface area, fracture volume, and production volume may be considered in selecting the target net treating pressure.

In one or more embodiments, the injection treatment may be designed to initiate one or more perforations or fractures 120 at the wellbore 102 and dilate one or more natural fractures in the one or more natural fracture networks 134. For example, computer or fracture modeling, geomechanics and numerical simulations can be used to determine the minimum net treating pressure that dilates natural fractures. The target range of net treating pressure may have a lower limit that is selected to ensure that one or more natural fractures are dilated by the stimulation or fracture treatment. In one or more embodiments, the lower limit of the target net treating pressure is selected to ensure that one or more perforations or fractures 120 are initiated and propagated in the formation at a desired time or growth rate. In one or more embodiments, no lower limit is specified.

Some of the techniques and operations described herein may be implemented by one or more information handling systems configured to provide the functionality described. In various embodiments, an information handling system may include any of various types of devices, including, but not limited to, personal computer systems, desktop computers, laptops, notebooks, mainframe computer systems, handheld computers, workstations, tablets, application servers, storage devices, or any type of computing or electronic device.

Computing subsystem 110 shown in FIG. 1 may simulate an injection treatment of the subterranean region 104. For example, the computing subsystem 110 may simulate and predict fracture initialization and propagation during stimulation or fracture treatments applied through the wellbore 102. The simulation may rely on a stimulation or fracture simulation system that reflects the actual physical process of stimulation or fracture treatments. The computing subsystem 110 may design or modify stimulation or fracture treatments based, at least in part, on the simulations. For example, the computing subsystem 110 may calculate, select, or optimize one or more treatment parameters, for example, one or more treatment parameters associated with stimulating or fracturing a formation 140, for initialization, propagation, or opening one or more perforations or fractures 120 in the subterranean region 104.

Figure 2:
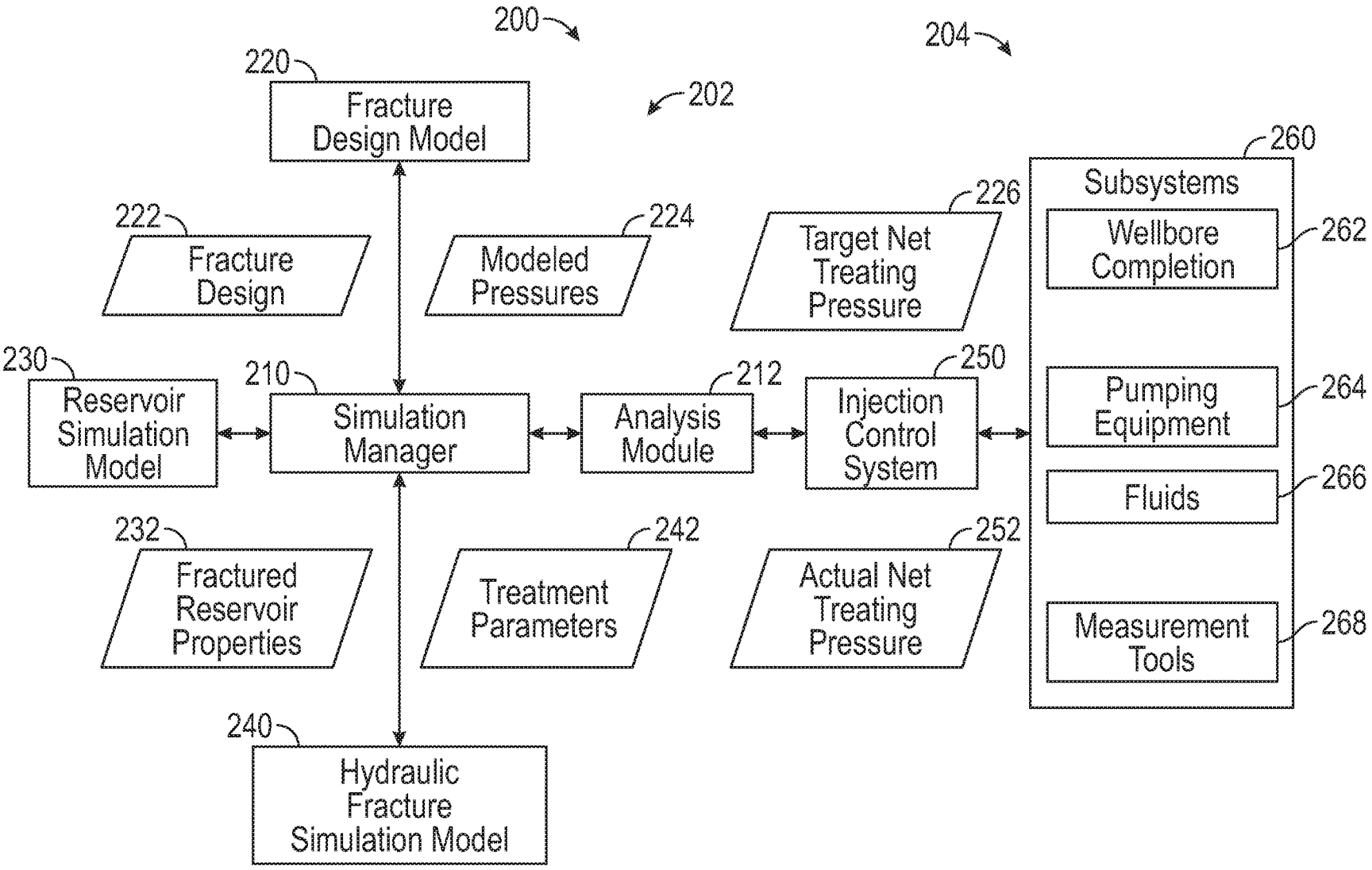
FIG. 2 is a schematic diagram of a wellbore treatment system architecture, according to one or more aspects of the present disclosure.

FIG. 2 is a schematic diagram of wellbore treatment system architecture 200 for a well system 100, according to one or more aspects of the present invention. The system architecture 200 includes an injection treatment design system 202 and an injection treatment system 204. The design system 202 may comprise a computing system, a design interface or other user-interface tools, various models, and other types of components. In one or more embodiments, the design system 202 may be implemented on a computing system such as injection treatment control subsystem 111 of FIG. 1 or information handling system 400 of FIG. 4. The injection treatment system 204 may be implemented in a well system associated with a subterranean region. In one or more embodiments, the injection treatment system 204 may be implemented in a well system, such as the well system 100 shown in FIG. 1 or another type of well system. In one or more embodiments, the example system architecture 200 may be used to implement some or all of the operations shown in FIG. 3, or the system architecture 200 may be used in another manner.

In one or more embodiments, various aspects of the design system 202 and the injection treatment system 204 may interact with each other or operate as mutually-dependent subsystems. In one or more embodiments, the design system 202 and the injection treatment system 204 are implemented as separate systems and operate substantially independently of one other. Generally, the design system 202 and the injection treatment system 204 may operate concurrently and execute operations (for example, in real time) in response to information provided by the other. In one or more embodiments, the design system 202 initially generates a design for an injection treatment, and the injection treatment system 204 later receives the design and performs the injection treatment. In one or more embodiments, the design system 202 refines the injection treatment design during the injection treatment in response to data and measurements provided by the injection treatment system 204.

The design system 202 shown in FIG. 2 comprises a simulation manager 210, an analysis module 212, a fracture design model 220, a reservoir simulation model 230, and a hydraulic fracture simulation model 240. A design system 202 may include additional or different modules, models, and subsystems. In one or more embodiments, one or more features of the example design system 202 may be implemented by one or more of the applications 458 of the computing subsystem 110 shown in FIGS. 2 and 4. The design system 202 may be controlled, monitored, initiated, or managed by one or more design engineers interacting with the design system 202, for example, through a user interface.

The example simulation manager 210 may interact with the one or more example models shown in FIG. 2 or other types of models to simulate an injection treatment. Simulation manager 210 may exchange fracture design data 222, modeled pressure data 224, one or more fractured reservoir properties 232, one or more treatment parameters 242, other information and any combination thereof with the one or more models, for example, models 220, 230 and 240. The example simulation manager 210 may interact with the analysis module 212 or the injection treatment system 204 to exchange (send, receive, or both send and receive) measurement data, simulation data, and other information. In one or more embodiments, the analysis module 212 generates the target net treating pressure 226 based on information from the simulation manager 210. The example analysis module 212 may interact with the injection treatment system 204 to exchange control information, one or more treatment parameters 242, fracture initialization information, fracture propagation information, one or more real-time pressure conditions and other information.

The example injection treatment system 204 comprises an injection control system 250 and one or more subsystems 260. In one or more embodiments, the injection control system 250 comprises a computing system or another type of system that provides control of the subsystems 260, for example, an information handling system 400 of FIG. 4. The one or more subsystems 260 may comprise wellbore completion equipment 262, pumping equipment 264, fluids 266, and one or more measurement tools 268. The subsystems 260 may be implemented by one or more pump trucks, one or more control trucks, one or more information handling systems, one or more working strings, one or more conduits, one or more communication links, one or more measurement systems, or by combinations of these and other types of equipment in a well system 100. The injection control system 250 may interact with additional or different subsystems to control an injection treatment. The injection control system 250 may be controlled or managed by one or more operations engineer interacting with the injection control system 250, for example, through a user interface or controls.

The injection control system 250 receives the target net treating pressure 226 from the analysis module 212 and controls one or more of the subsystems 260 based on the target net treating pressure 226. For example, the measurement tools 268 may generate (for example, by measurement, computation, etc.) actual net treating pressure data 252 based on a measured fluid pressure and the injection control system 250 may compare the actual net treating pressure with the target net treating pressure. In one or more embodiments, if the actual net treating pressure is outside a range or set of values specified by the target net treating pressure, the injection control system 250 may interface with the wellbore completion equipment 262, the pumping equipment 264, or the fluids 266 to modify the injection treatment. In one or more embodiments, the injection rate of a fluid, for example, treatment fluid 142 of FIG. 1, is compared to a threshold and the injection control system 250 may interface with the wellbore completion equipment 262, the pumping equipment 264, or the fluids 266 to modify the injection treatment to maintain a constant net treating pressure based, at least in part, on the injection rate of the fluid.

The fracture design model 220 may be a geomechanical fracture design model, a complex fracture design model, or another type of model. The fracture design model 220 may be used to generate fracture design data 222 that indicate fracture growth and fracture geometry (for example, length, width, spacing, orientation, etc.) or other fracture property data. The fracture design data 222 may be generated based on modeled fluid pressures acting on the subterranean region 104 during a wellbore treatment operation such as an injection treatment. For example, the simulation manager 210 may send the fracture design model 220 modeled pressure data 224 indicating various fluid pressures to be modeled. In one or more embodiments, the fracture design model 220 may model fracture growth in response to different injection parameters (for example, modeled fluid pressures, etc.), based on modeled rock properties (for example, modeled rock stresses, etc.). In one or more embodiments, the fracture design model 220 may predict or calculate the closure stress, Instantaneous Shut-In Pressure (ISIP), net treating pressure, the stress interference between fractures, or other fracture properties. In one or more embodiments, the fracture design data 222 may be collected by the simulation manager 210 and provided to the reservoir simulation model 230.

The analysis module 212 may use the data produced by one or more of the models (for example, data from the fracture design model 220, the reservoir simulation model 230, etc.) to determine the target net treating pressure 226 or another target parameter for an injection treatment. The target net treating pressure 226 may comprise a target maximum net treating pressure, or a range of net treating pressures between a minimum target value and a maximum target value. The target maximum net treating pressure 226 may be, for example, a maximum pressure that maintains a desired fracture growth orientation, a pressure that maximizes the exposed surface area, a pressure that maximizes leak off and the dilation of natural fractures, or a pressure that achieves a combination of these or other design goals. In one or more embodiments, the minimum target value may correspond to, for example, a minimum net treating pressure that is needed to create a fracture in the formation, while the maximum target value may correspond to the target maximum net treating pressure. In one or more embodiments, the minimum target value and the maximum target value may be configured as the optimal net treating pressure minus or plus certain error margins. Additional or different aspects may be considered in generating the target net treating pressure 226.

In one or more embodiments, the target net treating pressure 226 may be determined based on fracture growth orientation indicated by the fracture design data 222 produced by the fracture design model 220. For example, the target net treating pressure may be determined as a maximum net treating pressure that may be sustained during a stimulation or fracturing treatment without causing a stress reversal or causing the dominant fractures to reorient or grow together. As an example, the fracture design model 220 may model fracture trajectories in response to fluid pressure (for example, net closure pressure, net treating pressure, etc.) acting on the subterranean region 104. The fracture growth with respect to different values of the modeled fluid pressure may be simulated. The target net treating pressure may be determined, for example, by identifying a fracture reorientation from the fracture trajectories and locating the value of the modeled fluid pressure that produced the fracture reorientation. As an example, a desired orientation of a dominant fracture may be perpendicular to the least principal stress direction (which, in some cases, is aligned with the wellbore's orientation). If the dominant fractures grow towards a direction aligned with the least principal stress direction (or toward a direction parallel to the orientation of the wellbore), it may imply that the modeled fluid pressure exceeds a desirable net treating pressure value. In one or more embodiments, the target net treating pressure may be determined from the modeled fluid pressure based on the occurrence of the fracture reorientation.

In one or more embodiments, the target net treating pressure 226 may be determined based at least in part on the stress contrast or stress anisotropy. The stress anisotropy may refer to the difference between the maximum and least principal stresses. In one or more embodiments, as the net treating pressure approaches the stress anisotropy, natural fractures can more easily dilate and accept fluid and possibly proppant. As a result, the fracture network may have a larger connected fracture surface area, a better fracture conductivity, or a higher effective permeability. On the other hand, in one or more embodiments, if the net treating pressure exceeds the stress anisotropy, the fracture growth behavior may be significantly altered to the extent that unfavorable conditions (for example, dominant fractures growing together) occur. In one or more embodiments, if the net treating pressure significantly exceeds the stress anisotropy, the fracture direction may shift by 90 degrees or another angle. In such cases, a dominant fracture may intersect a previous dominant fracture in the same wellbore without further imparting the net treating pressure on the reservoir and thus not creating more connected fracture surface area. Therefore, in one or more embodiments, the target net treating pressure may be set as close to the stress anisotropy as possible (for example, substantially equal to or less than the stress anisotropy). In one or more embodiments, the fracture design model 220 may test the fracture growth in response to multiple fluid pressure values selected in relation to the stress anisotropy and then determine the target net treating pressure based on modeled responses to the multiple selected fluid pressures.

In one or more embodiments, the fracture design model 220 may be executed for a variety of fracture spacing cases, lengths and widths to determine the target net treating pressure, or to establish the optimum net treating pressure increase. The determined target net treating pressure or the predicted ISIP values may be sent to the injection control system 250 to control the injection treatment. In one or more embodiments, the target net treating pressure or the predicted ISIP values may be used, for example, by a technical professional on location to determine if the desired conditions are being achieved and enable decisions during the course of the treatment and take actions to modify the injection treatment such that, for example, an actual net treating pressure comply with the target net treating pressure.

The reservoir simulation model 230 may be used to identify the number of wells for a reservoir and optimal well completion, to predict the flow and production of one or more fluids (for example, water, gas, oil, etc.), or to determine any other appropriate one or more parameters and one or more properties of the reservoir. In one or more embodiments, the reservoir simulation model 230 may be executed to perform sensitivity analysis to create a desired fracture design based on the fracture design data 222 (for example, in terms of desired fracture length, desired connected surface area, etc.). These parameters may indicate the stimulated volume and the exposed surface area within that volume. The stimulated volume can be the volume of a reservoir which is effectively stimulated to increase the well performance by hydraulic fracturing. The stimulated volume may be directly tied to the drainage volume or estimated ultimate recovery (EUR) for a given well in an unconventional reservoir (for example, for very low permeability formations such as shale). The connected fracture surface area may influence the ability to accelerate production in an unconventional reservoir. The stimulated volume and the connected fracture surface area can help establish the available reserves that can be produced and the rate at which they can be produced.

The reservoir simulation model 230 may simulate the stimulated volumes and the connected fracture surface areas of multiple fracture designs and help determine a target net treating pressure. In one or more embodiments, each fracture design may be, for example, provided by the fracture design model 220 with a corresponding net treating pressure. The fracture designs may include one or more of dominant fractures, natural fractures or fissures, with certain fracture properties (for example, average fracture length, width, spacing, etc.). The time evolution of the exposed fracture surface area and the accumulated hydrocarbon production of the multiple fracture designs may be simulated and recorded. An optimal or a desired fracture design can be determined, for example, by identifying the fracture design that returns the most production volume or at the highest production rate.

In one or more embodiments, the target net treating pressure can be identified based on the optimal or the desired fracture design with the corresponding net treating pressure. In one or more embodiments, the reservoir simulation model 230 may use the net treating pressure data when simulating the stimulated volumes and the connected fracture surface areas of one or more fracture designs. For example, the reservoir simulation model 230 may vary the net treating pressure acting on the subterranean area for a certain fracture design. In one or more embodiments, increasing the net treating pressure may dilate the natural fractures, inducing leak off of the hydraulic fracturing fluid into the natural fractures. Dilating and inducing more leak off induced fractures may increase the connected fracture surface area. The reservoir simulation model 230 may evaluate the impacts of the net treating pressure on the stimulated volume and the connected fracture surface area and help determine a target net treating pressure, for example, by identifying a net treating pressure that maximizes one or both of the stimulated volume and the connected fracture surface area of a fracture design.

In one or more embodiments, a reservoir simulation model 230 may assess the impact of the fracture design on well productivity modeling. For example, a reservoir simulation tool capable of modeling Discrete Fracture Networks (DFN) may model the DFN as a combination of parallel hydraulic fractures and orthogonal natural fractures. In one or more embodiments, hydraulic fracture properties including width, height, length, conductivity, etc. and natural fracture properties including fracture density, fracture length, fracture conductivity, etc. may be specified in the reservoir simulation. Being able to specify and vary the natural fracture density and conductivity while honoring the reservoir matrix permeability may help develop more realistic production predictions based upon the net treating pressure achieved. In one or more embodiments, the reservoir simulation tool can help evaluate the impact of natural fractures or fissures intersecting the dominant fracture on the production potential from a well. Some example simulations results have shown that, in some instances, a single dominant fracture can have less total gas production and a lower gas production rate than a fracture network with the dominant fracture intersecting multiple fractures or fissures. As a result, the single dominant fracture regime (for example, fractures resembling a spear of asparagus) may be less productive than the dilated a natural fracture network regime (for example, a fracture network resembling a head of broccoli). In some shale reservoirs, dilation of natural fractures can open these fracture systems and potentially prop them open sufficiently to retain adequate fracture conductivity to flow fluids back to the dominant fracture and into the well. Since the matrix permeability in some of these types of reservoirs is so low, the dilation of these natural fractures may increase the connected fracture area and the effective permeability so the well can produce at higher production rates. In one or more embodiments, the reservoir simulation model 230 may also be used to history match production to provide a means to calibrate the design tool for one or more new wells.

The hydraulic fracture simulation model 240 may be used to determine one or more treatment parameters 242 for achieving a desired fracture design. For example, the fractured reservoir properties data 232 may be generated by the reservoir simulation tool 230 and serve as an input into the hydraulic fracture simulation model 240. The desired fracture design may include fracture geometry, for example, fracture length, volume of fluid leaked off into the natural fracture systems, or any other appropriate information. The hydraulic fracture simulation model 240 may determine the required one or more treatment parameters 242 including injection plan (for example, where to inject, how many fracturing stages, etc.), or one or more other properties of an injection treatment (for example, flow volume, fluid type, injection rate, proppant type, proppant concentrations, etc.) to achieve desired fracture network properties. In one or more embodiments, pressure sensitive leak off coefficients may be used to simulate the leak off of fluid into the natural fractures and generate a treatment pumping schedule including injection rates, treatment volumes, proppant concentrations and proppant volume. The one or more treatment parameters 242 may be collected by the simulation manager 210 and communicated to the injection control system 250 or one or more of the subsystems 260.

The injection control system 250 may control operations of the subsystems 260. The injection control system 250 may include a user interface that may be operated by a user to access, input, modify, or otherwise manipulate the injection parameters. The injection control system 250 may include computer-implemented algorithms that may automatically control the subsystems 260 or injection control system 250 may operate based on a combination of computer-implemented algorithms and user-controlled criteria. The injection control system 250 may include one or more features of the injection treatment control subsystem 111 described with respect to FIG. 1. In one or more embodiments, the injection control system 250 may receive (for example, from the simulation manager 210, from the analysis module 212, or another source) one or more treatment parameters 242, target net treating pressure 226, or any other appropriate information related to the injection treatment to be applied to a subterranean region. In one or more embodiments, the injection control system 250 may modify the received injection treatment information or the injection control system 250 may generate one or more new treatment parameters 242 or control information to configure the subsystems 260 or other equipment to execute aspects of the injection treatment plan.

In one or more embodiments, the injection control system 250 may receive data collected from the subterranean region 104 by sensing equipment or field tests, process the data or otherwise use the data to select or modify properties of an injection treatment to be applied to the subterranean region 104. For example, the injection control system 250 may receive a measurement of a surface pressure, a bottom hole treating pressure, a fracture closure pressure, Instantaneous Shut In Pressure (ISIP), in-situ stresses, fluid loss, leak off rate, or any other appropriate information. Such information may be collected from sensing equipment or sensors 144 of FIG. 1 (for example, flow meters, pressure sensors, tiltmeters, geophones, microseismic detecting devices, fiber optic sensors for distributed temperature, acoustic, any other type of sensor and any combination thereof) before, during, or after an injection treatment, or determined by a logging run with a dipole sonic wellbore logging instrument, a wellbore breakout analysis, an injection test (for example, an in-situ stress test, a minifracture test, a pump-in/flowback test, etc.), a fracturing analysis (for example, step-rate analysis, step down analysis, regression analysis, derivative method, etc.), an after-closure analysis, or another technique. As an example, the net treating pressure may be determined, for example, based on one or more of the surface pressure, the bottom hole pressure, the fracture closure pressure, or other information. The bottom hole pressure may be determined or based, at least in part, on downhole pressure data received at the surface 106 by computing subsystem 110 from one or more sensors 144 disposed or positioned downhole in wellbore 102 or on measured surface pressure from one or more sensors 144 disposed or positioned at the surface 106 along with a determined friction pressure. As another example, during completion, a Diagnostic Fracture Injection Test (DFIT) may be performed to evaluate the real leak off rates to validate the assumed values used during the treatment design and modify the pumping schedule (for example, injection rate, fluid type, proppant type, proppant concentration, diverter, etc.) as necessary.

In one or more embodiments, the injection control system 250 may control the subsystems 260 to maintain an actual net treating pressure that is consistent with the target net treating pressure, for example, to achieve desirable fracture growth. The actual net treating pressure can be determined, for example, based on the monitored treating pressure during the pumping or the recorded ISIP. The actual net treating pressure may be monitored and compared with a target net treating pressure. Adjustments of the actual net treating pressure may be made based on the comparison result as whether to increase or reduce the actual net treating pressure. In one or more embodiments, the adjustments may include modifying one or more injection parameters (for example, pumping pressure, adding diversion materials, change proppant size, proppant type, proppant concentration, etc.) instantaneously. In one or more embodiments, the adjustments may include modifying injection schedules that have a prospective effect on the actual net treating pressure in the subterranean area (for example, modifying the pumping schedule of a next stage fracturing treatment based on fracture conditions of the current stage, altering fracture or perforation spacing between treatment stages based on the observed treating pressure condition). The above process may be performed by a technical professional on location interacting with the injection control system 250 or one or more of the subsystems 260, or by the injection control system 250 with automatic algorithms or any other appropriate techniques.

In one or more embodiments, if the net treating pressure is below the target net treating pressure range, the subsystems 260 may be manipulated, for example, by the injection control system 250, to increase the actual net treatment pressure, for example, by pumping controls, diversion solutions, stress interference, or other techniques. Diversion methods may induce partial screen outs by pumping proppants or degradable material into the fracture network to increase the net treating pressure and create secondary fractures. The subsystems 260 may use or include AccessFrac or CobraMax DM family of products and services developed by Halliburton Energy Services, Inc., for example, to perform real time diversion to monitoring and maintaining the net treating pressure within the target net treating pressure range. In one or more embodiments, additional or fewer diversion stages may be used to help achieve and maintain the desired net treating pressure. Stress interference methods may use the altered effective stress state in the rock by using fractures created in a nearby well or zone to generate favorable conditions for fracture creation. Local stress interference may increase fracture complexity through the interaction of multiple fractures in the same well or nearby wells. Altering the sequence of fracture placement and alternating treatments in different wellbores may help increase fracture complexity in suitable reservoir conditions. The local stress interference may be performed sequentially to take advantage of localized stress alterations. The subsystems 260 may use or include CobraMax ASF, Zipper Frac, or other fracturing technologies developed by Halliburton Energy Services, Inc., for example, to alter stresses and improve the complexity of the fracture network. Another technique for increasing or decreasing the stress interference between fractures is to alter perforation or fracture spacing. In one or more embodiments, a closer spacing between perforations or fractures may lead to more stress interference, while a larger spacing between perforations or fractures may result in less interference between fractures. The perforations or fractures spacing between treatment stages may be altered (for example, during plug and perforation procedures) based on the observed net treating pressure condition, for example, to control the degree of the stress interference in the rock formation. The perforations or fractures spacing may be optimized to make use of the resulting stress interference to achieve and maintain the target net treating pressure, for example, by maintaining a constant net treating pressure as discussed with respect to FIG. 3.

In one or more embodiments, if the net treating pressure is above the target net treating pressure range, the subsystems 260 may be manipulated, for example, by the injection control system 250, to reduce the net treatment pressure, for example, by decreasing a pumping rate, decreasing a pumping pressure, adding materials to temporarily block the path created by the over-pressure events, etc. Also, if the injection rate is above or below a injection rate threshold, the subsystems 260 may be similarly manipulated to adjust the injection rate.

One or more of the subsystems 260 may operate together to perform an injection treatment by injecting fluid into a subterranean region (for example, the subterranean region 104). The subsystems 260 may include one or more features of the example injection system 108 described with respect to FIG. 1. The subsystems 260 may be controlled by the injection control system 250 to perform the injection treatment based on the one or more treatment parameters 242 (for example, injection rate, fluid type, proppant type, proppant concentration, pump rate of one or more pumps, selection, activation or de-activation of one or more pumps, etc.), pumping schedule, and planned fracture or perforation spacing between injection stages. Additionally or alternatively, the subsystems 260 may also be controlled by one or more technical professionals on location to adjust the treatment parameters 242 and schedules, for example, to improve the fracture growth behavior, and maximize the production potential. The subsystems 260 may be controlled in real time or dynamically.

Figure 3:
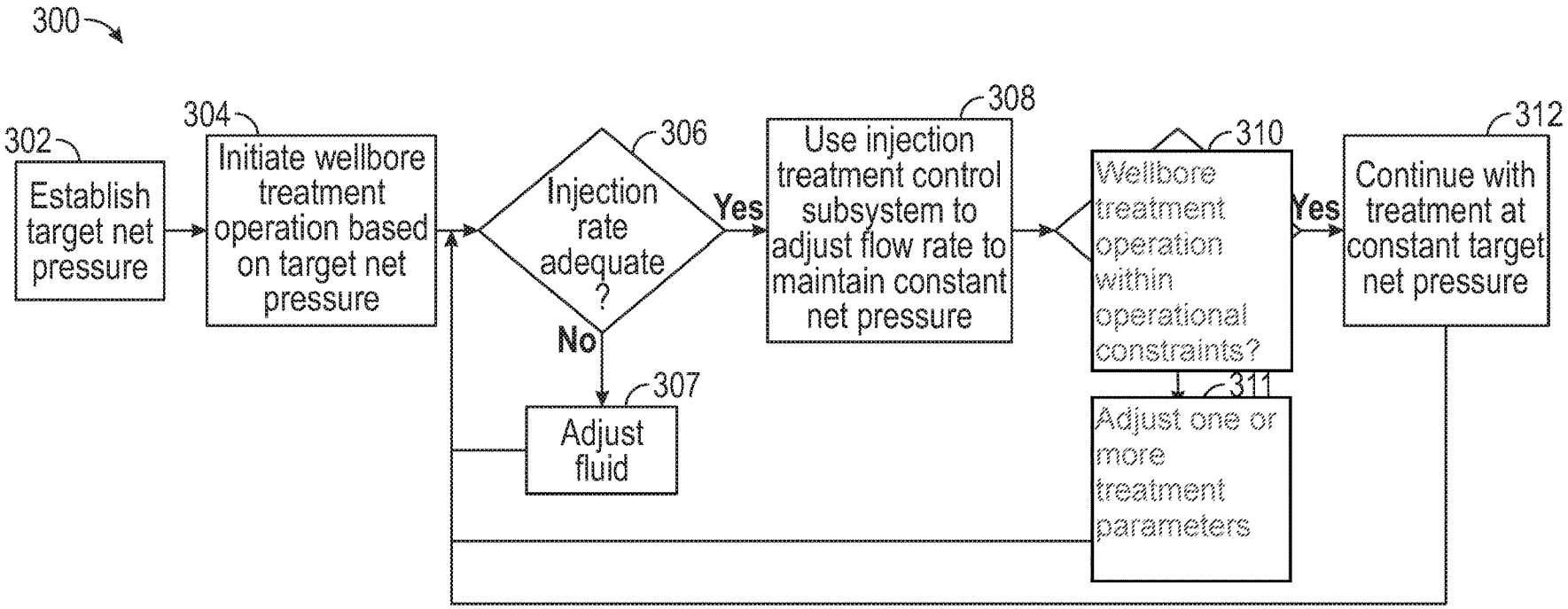
FIG. 3 is a flow chart for a wellbore treatment operation, according to one or more aspects of the present disclosure.

FIG. 3 is a flow chart for a wellbore treatment operation 300, according to one or more aspects of the present disclosure. At step 302, the target net treating pressure is established or determined. For example, the target net treating pressure may be established or determined as discussed with respect to the target net treating pressure 226 generated by analysis module 212 as discussed with respect to FIG. 2. An injection treatment control subsystem 111 of FIG. 1, a wellbore treatment system architecture 200 of FIG. 2, a controller, an information handling system or any other computing device may be used to determine or establish the target net treating pressure. In one or more embodiments, a user or operator may provide a target net treating pressure as an input to an application or software program, for example, a target net treating pressure based on historical data associated with one or more other wellbore treatment operations. In one or more embodiments, the target net treating pressure may be a range of pressures where the maximum and minimum pressure limits are based on any one or more of the one or more treatment parameters 242. For example, the maximum target net treating pressure may be an operational limit of an equipment and the minimum target net treating pressure may be a formation limit. In one or more embodiments, the target net treating pressure may be based, at least in part, on a least principal stress, a maximum principal stress or both. The least principal stress represents the lowest treating pressure at which an open fracture can exist within the target reservoir. A treating pressure drop below this value is indicative of a fracture that has penetrated into a zone of lower stress or that a tubular failure has occurred either of which may trigger termination of the wellbore treatment operation. The maximum principal stress establishes a treating pressure at which one or more fractures perpendicular to a primary hydraulic fracture can dilate and propagate away from the primary fracture which may result in excessive fluid loss. In conventional reservoirs such one or more fractures perpendicular to the primary hydraulic fracture may lead to an early screen out. In unconventional reservoirs, however, these one or more fractures perpendicular to the primary hydraulic fracture create more exposed surface area and are considered a beneficial provided that a sufficient injection rate can be maintained at the treating pressure associated with the maximum principal stress. The target net treating pressure is the net pressure required for performing a wellbore treatment operation at the wellbore treatment system, for example, the well system 100 discussed with respect to FIGS. 1 and 2.

In one or more embodiments, one or more treatment parameters 242, may be used to establish or determine the target net treating pressure, for example, prior to initiating a wellbore treatment operation, and the one or more treatment parameters may be altered during the wellbore treatment operation to maintain the net treating pressure of the wellbore treatment operation at the established or determined target net treating pressure. The one or more treatment parameters 242 may comprise any one or more treatment parameters 242 discussed above, equipment operational limits, configuration of one or more pumps (including, but not limited to, selection for activation or de-activation of one or more pumps), pressure of the treatment fluid 142, flow rate of the treatment fluid 142, fracturing modeling or simulations results, geomechanics, a formation limit (for example, minimum horizontal stress, maximum horizontal stress or both) may be used to establish the target net treating pressure. For example, a configuration of one or more pumps may be associated with a wellbore treatment operation and the target net treating pressure may be based, at least in part, on the configuration of the one or more pumps.

At step 304, a wellbore treatment operation is initiated, for example, a cementing, stimulation, injection or fracturing operation, including at least pumping or injecting a fluid. For example, the wellbore treatment operation may be initiated manually, using one or more of an injection treatment control subsystem 111, one or more subsystems 260, a controller and an information handling, manually, or any combination thereof. In one or more embodiments, treatment fluid 142 of FIG. 1 is flowed at an initial flow rate or injection rate downhole in the wellbore 102 to maintain a constant net treating pressure at or about the target net treating pressure. In one or more embodiments, the minimum injection rate may be set at or about 1 barrels per minute (bpm) (or at or about 0.159 cubic meters per minute) to 3 bpm (at or about 0.477 cubic meter per minute) per perforation shot in the casing. For wellbore treatment operations where control is exerted over the overall number of perforations to maintain back pressure so as to achieve more uniform flow through each perforation, the target injection rate may be set at or about 3 bpm (at or about 0.477 cubic meter per minute) per perforation depending upon the perforation diameter. For example, in one or more embodiments, the perforation is between ⅜ inch (0.9525 centimeter) to 0.5 inches (1.27 centimeters) in diameter.

In one or more embodiments, the target net treating pressure may also require that one or more operational constraints associated with the wellbore treatment operation be established or determined. The one or more operational constraints may comprise one or more pressure thresholds associated with the treatment fluid 142, one or more flow rate or injection rate thresholds associated with the treatment fluid 142 or both. The one or more pressure thresholds may be based on one or more operational limits of equipment, a formation limit, any one or more other treatment parameters 242 as discussed above or any combination thereof. For example, a maximum pressure threshold may be based on one or more operational limits of an equipment and a minimum pressure threshold may be based on a formation limit. The one or more flow rate or injection rate may be based on velocity typically in the range of 35-40 feet per second (at or about 10.668-12.192 meters per second) and altered or adjusted to help prevent equipment erosion. Erosion of, for example, surface manifolding, wellhead, casing, perforations or nay combination thereof, one or more operational limits of an equipment, proppant transport, any other one or more treatment parameters 242 discussed above or any combination thereof. For example, the maximum injection rate threshold may be based on velocity, erosion or an operational limit of an equipment and the minimum injection rate may be based on sufficient proppant transport in the horizontal wellbore. For a horizontal wellbore, this minimum velocity may be at or about 20 feet/second (at or about 6.096 meters/second).

At step 306, the injection treatment control subsystem 111 of FIG. 1, one or more subsystems 260, a controller, an information handling system or any combination thereof determines whether the initial flow rate or injection rate is adequate or sufficient to provide placement or disposition of the fluid, for example, treatment fluid 142 of FIG. 1. For example, the initial flow rate or injection rate should not be less than 1 bpm (at or about 0.159 cubic meters per minute) per perforation or that sufficient to provide a minimum velocity of the treatment fluid 142 in the conduit 112 of 20 feet/second (at or about 6.096 meters/second). In one or more embodiments, the placement or disposition of the fluid in the wellbore is monitored and if the initial flow or injection rate is not adequate or sufficient to place or dispose the fluid at one or more perforations or fractures (for example, perforations or fractures 120, 132) within the subterranean region (for example, subterranean region subterranean region 104), then at step 307, one or more characteristics or parameters of the treatment fluid 142 is altered or otherwise adjusted to dispose the treatment fluid 142 in one or more perforations or fractures. For example, once a minimum flow rate or injection rate of 1 bpm (at or about 0.159 cubic meters per minute) or a velocity of the treatment fluid 142 in the conduit 112 has reached 20 feet/second (at or about 6.096 meters/second), it may be assumed that the treatment fluid 142 has been disposed at or in the one or more perforations or fractures. For example, adjusting one or more characteristics or parameters of the treatment fluid 142 may comprise adding or mixing one or more resources, including, but not limited to, a microproppant (for example, to reduce tortuosity), a reactive fluid (for example an acid), a viscous gel, a sand scour, any other type of mixture, fluid, and any combination thereof. After adjustment of the fluid, the process returns to step 306. If adjustment of the treatment fluid 142 does not provide for an adequate placement of the treatment fluid 142 downhole, for example, within the subterranean formation 140, then early termination of the wellbore treatment operation may be considered. For example, the wellbore treatment operation may be terminated based, at least in part, on the flow rate or injection rate of the treatment fluid 142, falling below or exceeding a threshold, a pressure of the treatment fluid 142 falling below or exceeding a threshold, exhaustion or depletion at or below a threshold of one or more resources, expiration of a timer or failure to meet requirements of step 306 within time threshold, the fluid achieving or exceeding a threshold level for viscosity, fluidity, density or any other parameter or any combination thereof. In one or more embodiments, the wellbore treatment operation may be terminated if a screen out condition occurs.

If at step 306, the flow or injection rate of the fluid is adequate, then at step 308, the injection treatment control subsystem 111, one or more subsystems 260, controller, information handling system or any combination thereof continuously adjusts the flow or injection rate of the treatment fluid 142 by increasing or decreasing the flow rate or injection rate to maintain the constant net treating pressure established at step 302. The flow rate or injection rate may be controlled by adjusting the running parameters (including, but not limited to, any one or more of pump speed, engine speed, throttle setting and gear setting) for any one or more pumps. In one or more embodiments, the injection treatment control subsystem 111 maintains the target net treating pressure based on one or more operational constraints. For example, the injection treatment control subsystem 111 may control, directly or indirectly, one or more pumps to maintain the target net treating pressure while pumping the treatment fluid 142 at or within the one or more pressure thresholds, the one or more injection rate thresholds or both.

At step 310, the injection treatment control subsystem 111, controller, information handling system or any combination thereof determines if the wellbore treatment operation is being performed within one or more operational constraints. For example, one or more measurements associated with the wellbore treatment operation are received and compared to the associated one or more operational constraints to determine if the wellbore treatment operation is performing within the one or more operational constraints. For example, the one or more sensors 144 of FIG. 1 may communicate one or more measurements associated with at least one of the one or more operational constraints. The one or more measurements are compared to the one or more operational constraints associated with the one or more measurements to determine if the wellbore treatment operation is performing within the one or more operational constraints. If the one or more measurements indicate that the wellbore treatment operation is performing within the associated one or more operational constraints, then no adjustments to the wellbore treatment operation are required.

If the one or more measurements indicate that the wellbore treatment operation is not performing within the associated one or more operational constraints, then at step 311 one or more treatment parameters may be altered or adjusted. For example, a measurement indicative of the flow or injection rate of the treatment fluid 142 may be compared to the one or more operational constraints associated with the flow rate or injection rate of the treatment fluid 142. If the comparison indicates that the flow or injection rate of the treatment fluid 142 is at or above a threshold or not within any one or more of the one or more operational constraints, then at step 311 one or more treatment parameters 242 are adjusted or altered. For example, the one or more treatment parameters 242 may comprise flow rate or injection rate, composition of the treatment fluid 142 (such as discussed with respect to step 307), pressure of the treatment fluid 142, or any combination thereof. In one or more embodiments, the flow rate or injection rate of the treatment fluid 142 may be lowered by decreasing pump speed to keep the wellbore treatment operation within the one or more operational constraints while maintaining the wellbore treatment operation at the target net treating pressure as a constant net treating pressure.

In one or more embodiments, the net treating pressure of the wellbore treatment operation may be adjusted or altered to improve fracture growth behavior at specific times during a wellbore treatment operation which requires a lower flow or injection rate. Thus, the target net treating pressure may be established based on a new criteria for the wellbore treatment operation. For example, during a near wellbore diversion, the target net treating pressure may be set such that the net treating pressure of the wellbore treatment operation is dropped to a desired level to automatically reduce the flow rate or injection rate as the diverter in the fluid reaches the one or more perforations or fractures. Dropping the net treating pressure essentially stops the fluid from entering the one or more perforations or fractures that did not take large fluid volumes during the higher flow rate or injection rate resulting in the fluid following the path of least resistance and into one or more dominant fractures. The diverter is selectively placed or flowed into the one or more dominant fractures to at least partly plug the one or more dominant fractures during the diversion cycle. Once the diverter is positioned or placed, the target net treating pressure set point may be increased such that the net treating pressure of the wellbore treatment operation enables break down of one or more new, undertreated perforations or fractures as well as achieving more effective proppant placement in one or more perforations or fractures or a cluster of perforations or fractures. Also, during early stages of a wellbore treatment operation, fracture tortuosity or complexity may result in excessively high treating pressures due to high leak off into one or more new wellbore fractures. During this leak off period, keeping fracture geometry as simple as possible is beneficial at least until the one or more perforations or fractures have penetrated beyond the near wellbore region (for example, ten to twenty feet). Keeping fracture geometry simple may be achieved by using a lower net treating pressure set point that is maintained at a net treating pressure near the minimum principal stress, but below the level of stress anisotropy (minimum horizontal stress and maximum horizontal stress). Once the one or more perforations or fractures have penetrated beyond the near wellbore region, the target net treating pressure set point may be increased to a level near or slightly above the level of stress anisotropy so that the net treating pressure of the wellbore operation induces more leak-off into one or more natural fractures and secondary porosity to create a more exposed fracture area deeper in the reservoir (for example, 144 of a subterranean formation 140 of FIG. 1).

If the flow or injection rate is within the one or more operational constraints at step 310, then the wellbore treatment operation continues at the constant net treating pressure without altering or adjusting one or more treatment parameters 242. For example, the flow rate or injection rate may be maintained without adjustment or alteration. Maintaining the net treatment pressure of a wellbore treatment operation at a constant net treating pressure during the wellbore treatment operation, for example, a stimulation or fracturing operation, provides improved control of the net treating pressure required for creating, initiating, expanding or extending a perforation or fracture by reducing pressure dependent leakoff and tip screenouts, control of perforation or fracture growth and complexity by maintaining a constant net treating pressure before and after diversion, discrimination of when diversion is needed by detection of flow or injection rate increases at constant net treating pressure (for example, by better detection of sudden fracturing length associated with low incident angles between hydraulic fractures and natural fractures where sooner diversion may help minimize parent/child fracture interaction and improved detection of contained fracture growth in either length or height by connecting to regions of depleted pore pressure and stress), and containment of fracturing height by preventing pressure increases often observed using conventional techniques of constant flow or injection rate that could cause failure of potential height barriers resulting in excessive height of the perforation or fracture. Additionally, the target net treating pressure may be continuously and automatically varied throughout the wellbore treatment operation to achieve a desired net treating pressure profile so as to enhance formation breakdown and fracture complexity.

In one or more embodiments, the target net treating pressure may be maintained at a set point for a predetermined period of time and the wellbore treatment operation 300 may be performed according to one or more steps of FIG. 3. At the expiration of the predetermined period of time, the target net treating pressure may be altered or changed to a different set point and operation of the wellbore treatment operation may continue according to one or more steps of FIG. 3. In this way, a constant net treating pressure is maintained at a set point for a known duration of time.

In one or more embodiments, any one or more steps may be performed in any order and one or more steps may be omitted or repeated.

Figure 4:
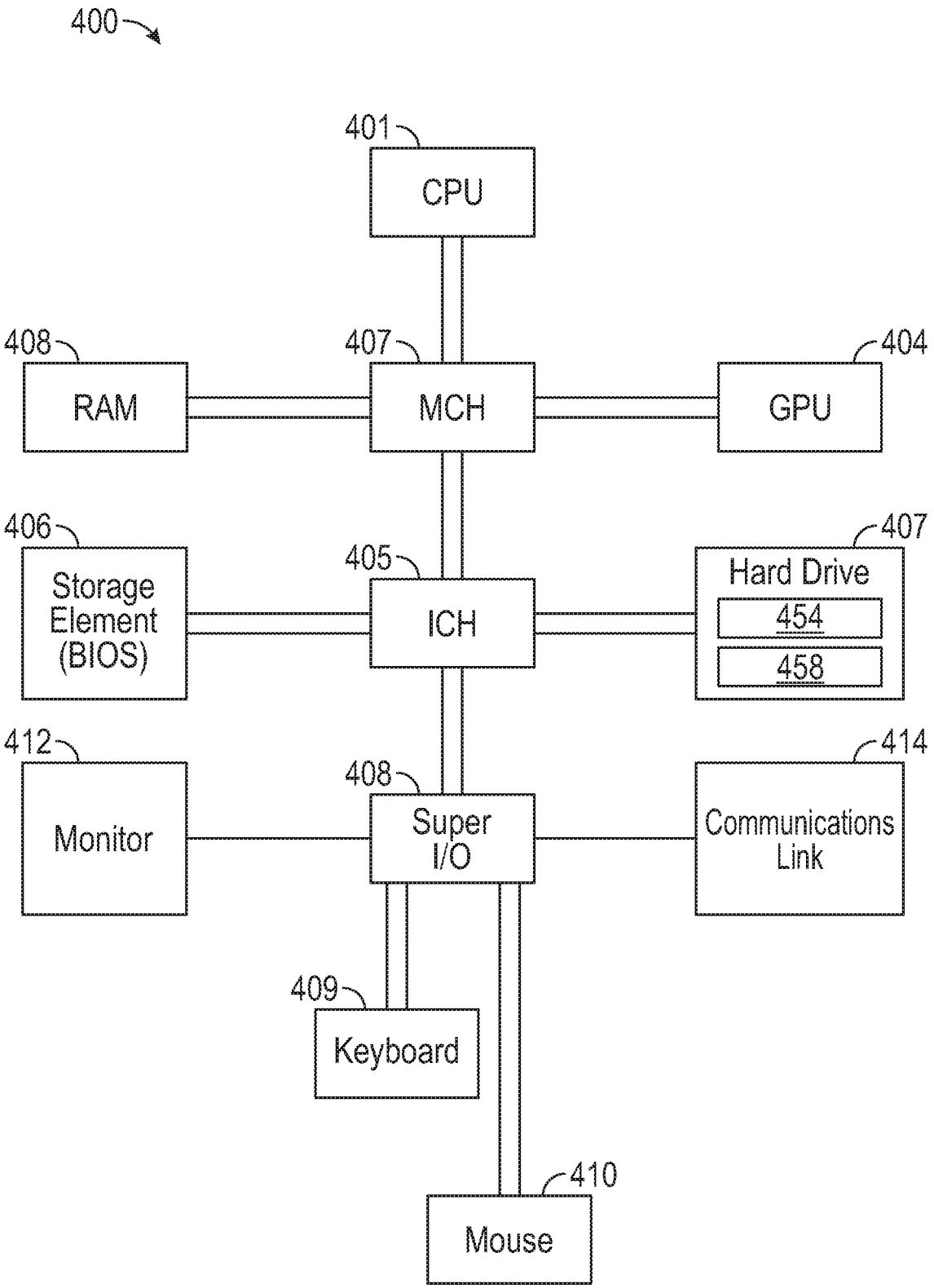
FIG. 4 is a schematic diagram of an information handling system for a well system, according to one or more aspects of the present disclosure.

FIG. 4 is a diagram illustrating an example information handling system 400, for example, for use with or by an associated wellbore system 100 of FIG. 1, according to one or more aspects of the present disclosure. The computing subsystem 110 of FIG. 1 may take a form similar to the information handling system 400. A processor or central processing unit (CPU) 401 of the information handling system 400 is communicatively coupled to a memory controller hub (MCH) or north bridge 402. The processor 401 may include, for example a microprocessor, microcontroller, digital signal processor (DSP), application specific integrated circuit (ASIC), or any other digital or analog circuitry configured to interpret and/or execute program instructions and/or process data. Processor 401 may be configured to interpret and/or execute program instructions or other data retrieved and stored in any memory such as memory 403 or hard drive 407. Program instructions or other data may constitute portions of a software or application, for example application 458 or data 454, for carrying out one or more methods described herein. Memory 403 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 458 or data 454 may be retrieved and stored in memory 403 for execution or use by processor 401. In one or more embodiments, the memory 403 or the hard drive 407 may include or comprise one or more non-transitory executable instructions that, when executed by the processor 401 cause the processor 401 to perform or initiate one or more operations or steps. The information handling system 400 may be preprogrammed or it may be programmed (and reprogrammed) by loading a program from another source (for example, from a CD-ROM, from another computer device through a data network, or in another manner).

The data 454 may include treatment data, geological data, fracture data, microseismic data, or any other appropriate data. The one or more applications 458 may include a fracture design model, a reservoir simulation tool, a fracture simulation model, or any other appropriate applications. In one or more embodiments, a memory of a computing device includes additional or different data, application, models, or other information. In one or more embodiments, the data 454 may include treatment data relating to fracture treatment plans. For example the treatment data may indicate a pumping schedule, parameters of a previous injection treatment, parameters of a future injection treatment, or one or more parameters of a proposed injection treatment. Such one or more parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 454 may include geological data relating to one or more geological properties of the subterranean region 104. For example, the geological data may include information on the wellbore 102, completions, or information on other attributes of the subterranean region 104. In one or more embodiments, the geological data includes information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 454 include fracture data relating to fractures in the subterranean region 104. The fracture data may identify the locations, sizes, shapes, and other properties of fractures in a model of a subterranean zone. The fracture data can include information on natural fractures, hydraulically-induced fractures, or any other type of discontinuity in the subterranean region 104. The fracture data can include fracture planes calculated from microseismic data or other information. For each fracture plane, the fracture data can include information (for example, strike angle, dip angle, etc.) identifying an orientation of the fracture, information identifying a shape (for example, curvature, aperture, etc.) of the fracture, information identifying boundaries of the fracture, or any other suitable information.

The one or more applications 458 may comprise one or more software applications, one or more scripts, one or more programs, one or more functions, one or more executables, or one or more other modules that are interpreted or executed by the processor 401. For example, the one or more applications 458 may include a fracture design module, a reservoir simulation tool, a hydraulic fracture simulation model, or any other appropriate function block. The one or more applications 458 may include machine-readable instructions for performing one or more of the operations related to any one or more embodiments of the present disclosure. The one or more applications 458 may include machine-readable instructions for generating a user interface or a plot, for example, illustrating fracture geometry (for example, length, width, spacing, orientation, etc.), pressure plot, hydrocarbon production performance. The one or more applications 458 may obtain input data, such as treatment data, geological data, fracture data, or other types of input data, from the memory 403, from another local source, or from one or more remote sources (for example, via the one or more communication links 414). The one or more applications 458 may generate output data and store the output data in the memory 403, hard drive 407, in another local medium, or in one or more remote devices (for example, by sending the output data via the communication link 414).

Modifications, additions, or omissions may be made to FIG. 4 without departing from the scope of the present disclosure. For example, FIG. 4 shows a particular configuration of components of information handling system 400. However, any suitable configurations of components may be used. For example, components of information handling system 400 may be implemented either as physical or logical components. Furthermore, in some embodiments, functionality associated with components of information handling system 400 may be implemented in special purpose circuits or components. In other embodiments, functionality associated with components of information handling system 400 may be implemented in configurable general purpose circuit or components. For example, components of information handling system 400 may be implemented by configured computer program instructions.

Memory controller hub 402 may include a memory controller for directing information to or from various system memory components within the information handling system 400, such as memory 403, storage element 406, and hard drive 407. The memory controller hub 402 may be coupled to memory 403 and a graphics processing unit (GPU) 404. Memory controller hub 402 may also be coupled to an I/O controller hub (ICH) or south bridge 405. I/O controller hub 405 is coupled to storage elements of the information handling system 400, including a storage element 406, which may comprise a flash ROM that includes a basic input/output system (BIOS) of the computer system. I/O controller hub 405 is also coupled to the hard drive 407 of the information handling system 400. I/O controller hub 405 may also be coupled to an I/O chip or interface, for example, a Super I/O chip 408, which is itself coupled to several of the I/O ports of the computer system, including a keyboard 409, a mouse 410, a monitor 412 and one or more communications link 414. Any one or more input/output devices receive and transmit data in analog or digital form over one or more communication links 414 such as a serial link, a wireless link (for example, infrared, radio frequency, or others), a parallel link, or another type of link. The one or more communication links 414 may comprise any type of communication channel, connector, data communication network, or other link. For example, the one or more communication links 414 may comprise a wireless or a wired network, a Local Area Network (LAN), a Wide Area Network (WAN), a private network, a public network (such as the Internet), a WiFi network, a network that includes a satellite link, or another type of data communication network.

In one or more embodiments, a wellbore treatment operation method comprises stablishing a target net treating pressure for the wellbore treatment operation, establishing one or more operational constraints associated with the wellbore treatment operation, initiating a wellbore treatment operation by injecting a fluid in a wellbore of a formation based on the target net treating pressure, monitoring disposition of the fluid in the wellbore, receiving one or more measurements associated with the wellbore treatment operation, comparing the one or more measurements to the one or more operational constraints associated with the one or more measurements and maintaining a net treating pressure of the wellbore treatment operation at the target net treating pressure as a constant net treating pressure by adjusting one or more treatment parameters based on the comparison. In one or more embodiments, the one or more treatment parameters comprises at least one of a flow rate of the fluid, a composition of the fluid, a pressure of the fluid. In one or more embodiments, adjusting the one or more treatment parameters comprises adjusting a flow rate of the fluid. In one or more embodiments, the method further comprises adjusting the target net treating pressure during a near wellbore diversion to reduce the flow rate of the fluid. In one or more embodiments, the method further comprises adjusting the target net treating pressure after a duration of time. In one or more embodiments, adjusting the one or more treatment parameters comprises altering a configuration of one or more pumps associated with the wellbore treatment operation. In one or more embodiments, altering a characteristic of the fluid to dispose the fluid in one or more perforations of the formation.

In one or more embodiments, non-transitory computer-readable medium storing one or more instructions that, when executed by a processor, cause the processor to perform one or more operations comprises establishing a target net treating pressure for the wellbore treatment operation, establishing one or more operational constraints associated with the wellbore treatment operation, initiating a wellbore treatment operation by injecting a fluid in a wellbore of a formation based on the target net treating pressure, monitoring disposition of the fluid in the wellbore, receiving one or more measurements associated with the wellbore treatment operation, comparing the one or more measurements to the one or more operational constraints associated with the one or more measurements and maintaining a net treating pressure of the wellbore treatment operation at the target net treating pressure as a constant net treating pressure by adjusting one or more treatment parameters based on the comparison. In one or more embodiments, wherein the one or more treatment parameters comprises at least one of a flow rate of the fluid, a composition of the fluid, a pressure of the fluid. In one or more embodiments, adjusting the one or more treatment parameters comprises adjusting a flow rate of the fluid. In one or more embodiments, wherein the one or more operations further comprising adjusting the target net treating pressure during a near wellbore diversion to reduce the flow rate of the fluid. In one or more embodiments, the one or more operations further comprising at least one of adjusting the target net treating pressure after a duration of time and adjusting the one or more treatment parameters comprises altering a configuration of one or more pumps associated with the wellbore treatment operation. In one or more embodiments, the one or more operations further comprising altering a characteristic of the fluid to dispose the fluid in one or more perforations of the formation.

In one or more embodiments, a wellbore treatment system comprises an injection system, wherein the injection system comprises one or more pumping units and a computing subsystem, wherein the computing subsystem comprises at least one processor and a memory comprising one or more non-transitory executable instructions that, when executed, cause the at least one processor to establish a target net treating pressure for the wellbore treatment operation, establish one or more operational constraints associated with the wellbore treatment operation, initiate a wellbore treatment operation by injecting a fluid in a wellbore of a formation based on the target net treating pressure, monitor disposition of the fluid in the wellbore, receive one or more measurements associated with the wellbore treatment operation, compare the one or more measurements to the one or more operational constraints associated with the one or more measurements, and maintain a net treating pressure of the wellbore treatment operation at the target net treating pressure as a constant net treating pressure by adjusting one or more treatment parameters based on the comparison. In one or more embodiments, the one or more treatment parameters comprises at least one of a flow rate of the fluid, a composition of the fluid, a pressure of the fluid. In one or more embodiments, adjusting the one or more treatment parameters comprises adjusting a flow rate of the fluid. In one or more embodiments, the one or more non-transitory executable instructions that, when executed, further cause the at least one processor to adjust the target net treating pressure during a near wellbore diversion to reduce the flow rate of the fluid. In one or more embodiments, the one or more non-transitory executable instructions that, when executed, further cause the at least one processor to adjust the target net treating pressure after a duration of time. In one or more embodiments, the one or more non-transitory executable instructions that, when executed, further cause the at least one processor to adjust the one or more treatment parameters comprises altering a configuration of one or more pumps associated with the wellbore treatment operation. In one or more embodiments, the one or more non-transitory executable instructions that, when executed, further cause the at least one processor to alter a characteristic of the fluid to dispose the fluid in one or more perforations of the formation.

As would be appreciated by those of ordinary skill in the art, with the benefit of this disclosure, the methods of the present disclosure may be implemented on virtually any type of information handling system regardless of the platform being used. Moreover, one or more elements of the information handling system may be located at a remote location and connected to the other elements over a network. In a further embodiment, the information handling system may be implemented on a distributed system having a plurality of nodes. Such distributed computing systems are well known to those of ordinary skill in the art and will therefore not be discussed in detail herein.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are each defined herein to mean one or more than one of the element that it introduces.

A number of examples have been described. Nevertheless, it will be understood that various modifications can be made. Accordingly, other implementations are within the scope of the following claims.

What is claimed is:

1. A method of performing a wellbore treatment operation, comprising:

establishing a target net treating pressure for the wellbore treatment operation;

establishing one or more operational constraints associated with the wellbore treatment operation;

initiating the wellbore treatment operation by injecting a fluid in a wellbore of a formation based on the target net treating pressure;

monitoring disposition of the fluid in the wellbore;

adjusting an injection rate of the fluid to maintain a net treating pressure of the wellbore treatment operation at the target net treating pressure;

receiving one or more measurements associated with the wellbore treatment operation;

comparing the one or more measurements to the one or more operational constraints associated with the one or more measurements to determine if the wellbore treatment operation is performing within the one or more operational constraints; and in response to determining that the wellbore treatment operation is not performing within the one or more operational constraints, maintaining the net treating pressure of the wellbore treatment operation at the target net treating pressure as a constant net treating pressure by adjusting one or more treatment parameters based on the comparison, wherein the constant net treating pressure is maintained at a set point for a predetermined period of time.

2. The method of claim 1, wherein the one or more treatment parameters comprises at least one of a flow rate of the fluid, a composition of the fluid, a pressure of the fluid.

3. The method of claim 1, wherein adjusting the one or more treatment parameters comprises adjusting a flow rate of the fluid.

4. The method of claim 1, further comprising adjusting the target net treating pressure during a near wellbore diversion to reduce the flow rate of the fluid.

5. The method of claim 1, further comprising adjusting the target net treating pressure after a duration of time.

6. The method of claim 1, wherein adjusting the one or more treatment parameters comprises altering a configuration of one or more pumps associated with the wellbore treatment operation.

7. The method of claim 1, further comprising altering a characteristic of the fluid to dispose the fluid in one or more perforations of the formation.

8. A non-transitory computer-readable medium storing one or more instructions that, when executed by a processor, cause the processor to perform operations comprising:

establishing a target net treating pressure for a wellbore treatment operation;

establishing one or more operational constraints associated with the wellbore treatment operation;

initiating the wellbore treatment operation by injecting a fluid in a wellbore of a formation based on the target net treating pressure;

monitoring disposition of the fluid in the wellbore;

adjusting an injection rate of the fluid to maintain a net treating pressure of the wellbore treatment operation at the target net treating pressure;

receiving one or more measurements associated with the wellbore treatment operation;

comparing the one or more measurements to the one or more operational constraints associated with the one or more measurements to determine if the wellbore treatment operation is performing within the one or more operational constraints; and in response to determining that the wellbore treatment operation is not performing within the one or more operational constraints, maintaining the net treating pressure of the wellbore treatment operation at the target net treating pressure as a constant net treating pressure by adjusting one or more treatment parameters based on the comparison, wherein the constant net treating pressure is maintained at a set point for a predetermined period of time.

9. The non-transitory computer-readable medium of claim 8, wherein the one or more treatment parameters comprises at least one of a flow rate of the fluid, a composition of the fluid, a pressure of the fluid.

10. The non-transitory computer-readable medium of claim 8, wherein adjusting the one or more treatment parameters comprises adjusting a flow rate of the fluid.

11. The non-transitory computer-readable medium of claim 8, wherein the one or more operations further comprising adjusting the target net treating pressure during a near wellbore diversion to reduce the flow rate of the fluid.

12. The non-transitory computer-readable medium of claim 8, wherein the one or more operations further comprising at least one of adjusting the target net treating pressure after a duration of time and adjusting the one or more treatment parameters comprises altering a configuration of one or more pumps associated with the wellbore treatment operation.

13. The non-transitory computer-readable medium of claim 8, the one or more operations further comprising altering a characteristic of the fluid to dispose the fluid in one or more perforations of the formation.

14. A wellbore treatment system comprising:

an injection system, wherein the injection system comprises one or more pumping units; and a computing subsystem, wherein the computing subsystem comprises:

at least one processor; and a memory comprising one or more non-transitory executable instructions that, when executed, cause the at least one processor to:

establish a target net treating pressure for a wellbore treatment operation;

establish one or more operational constraints associated with the wellbore treatment operation;

initiate the wellbore treatment operation by injecting a fluid in a wellbore of a formation based on the target net treating pressure;

monitor disposition of the fluid in the wellbore;

adjust an injection rate of the fluid to maintain a net treating pressure of the wellbore treatment operation at the target net treating pressure;

receive one or more measurements associated with the wellbore treatment operation;

compare the one or more measurements to the one or more operational constraints associated with the one or more measurements to determine if the wellbore treatment operation is performing within the one or more operational constraints; and in response to determining that the wellbore treatment operation is not performing within the one or more operational constraints, maintain the net treating pressure of the wellbore treatment operation at the target net treating pressure as a constant net treating pressure by adjusting one or more treatment parameters based on the comparison, wherein the constant net treating pressure is maintained at a set point for a predetermined period of time.

15. The system of claim 14, wherein the one or more treatment parameters comprises at least one of a flow rate of the fluid, a composition of the fluid, a pressure of the fluid.

16. The system of claim 14, wherein adjusting the one or more treatment parameters comprises adjusting a flow rate of the fluid.

17. The system of claim 14, wherein the one or more non-transitory executable instructions that, when executed, further cause the at least one processor to adjust the target net treating pressure during a near wellbore diversion to reduce the flow rate of the fluid.

18. The system of claim 14, wherein the one or more non-transitory executable instructions that, when executed, further cause the at least one processor to adjust the target net treating pressure after a duration of time.

19. The system of claim 14, wherein the one or more non-transitory executable instructions that, when executed, further cause the at least one processor to adjust the one or more treatment parameters comprises altering a configuration of the one or more pumping units associated with the wellbore treatment operation.

20. The system of claim 14, wherein the one or more non-transitory executable instructions that, when executed, further cause the at least one processor to alter a characteristic of the fluid to dispose the fluid in one or more perforations of the formation.

* * * * *